US010113497B2

(12) United States Patent
Odendall

(10) Patent No.: US 10,113,497 B2
(45) Date of Patent: Oct. 30, 2018

(54) METHOD OF OPERATING A DRIVE DEVICE AND CORRESPONDING DRIVE DEVICE

(71) Applicant: AUDI AG, Ingolstadt (DE)

(72) Inventor: Bodo Odendall, Lenting (DE)

(73) Assignee: Audi AG, Ingolstadt (DE)

( * ) Notice: Subject to any disclaimer, the term of this patent is extended or adjusted under 35 U.S.C. 154(b) by 417 days.

(21) Appl. No.: 14/886,854

(22) Filed: Oct. 19, 2015

(65) Prior Publication Data

US 2016/0108836 A1 Apr. 21, 2016

(30) Foreign Application Priority Data

Oct. 20, 2014 (DE) ..... 10 2014 015 523

(51) Int. Cl.

| | |
|---|---|
| ***F02D 41/02*** | (2006.01) |
| ***F02D 41/14*** | (2006.01) |
| ***F02D 41/24*** | (2006.01) |
| ***F01N 3/20*** | (2006.01) |

(52) U.S. Cl.

CPC ..... *F02D 41/0235* (2013.01); *F01N 3/2066* (2013.01); *F02D 41/0275* (2013.01); *F02D 41/1441* (2013.01); *F02D 41/2474* (2013.01)

(58) Field of Classification Search

CPC ..... F02D 41/0235; F02D 41/0275; F02D 41/1441; F02D 41/2474; F01N 3/2066

USPC ..... 60/274, 286, 295

See application file for complete search history.

(56) References Cited

U.S. PATENT DOCUMENTS

| | | | |
|---|---|---|---|
| 6,550,307 B1 | 4/2003 | Zhang et al. | |
| 6,637,194 B2 | 10/2003 | Kakuyama et al. | |
| 8,522,608 B2 | 9/2013 | Odendall | |
| 8,826,722 B2 | 9/2014 | Odendall | |
| 2004/0103642 A1 | 6/2004 | Rosel et al. | |
| 2009/0151323 A1* | 6/2009 | Severin | F01N 3/023 60/276 |
| 2012/0031075 A1 | 2/2012 | Odendall | |
| 2012/0053816 A1 | 3/2012 | Odendall | |

(Continued)

FOREIGN PATENT DOCUMENTS

| | | |
|---|---|---|
| CN | 1364214 | 8/2002 |
| DE | 2012 019 907 A1 | 4/2014 |
| EP | 1 373 700 B1 | 1/2004 |

*Primary Examiner* — Phutthiwat Wongwian

*Assistant Examiner* — Kelsey Stanek

(74) *Attorney, Agent, or Firm* — Henry M. Feiereisen LLC

(57) ABSTRACT

A method for operating a drive device with an internal combustion engine and an exhaust gas tract having a storage catalytic converter for purifying exhaust gas, a first lambda probe disposed upstream of the storage catalytic converter and a second lambda probe disposed downstream of the storage catalytic converter, includes determining a lambda value for controlling a mixture composition for the internal combustion engine based on a measurement signal from the first lambda probe and an offset value. The offset value is determined with a trim control when a measurement signal of the second lambda probe is in a normal operating range of values, and is adjusted in a regeneration period, during which the storage catalytic converter regenerated, with a predetermined correction value when the measurement signal of the second lambda probe is outside the normal operating range of values. A corresponding drive device is also disclosed.

12 Claims, 2 Drawing Sheets

(56) References Cited

U.S. PATENT DOCUMENTS

| | | | | |
|---|---|---|---|---|
| 2013/0074817 | A1* | 3/2013 | Fisher | F02M 21/0215 123/674 |
| 2015/0260118 | A1 | 9/2015 | Odendall | |

* cited by examiner

METHOD OF OPERATING A DRIVE DEVICE AND CORRESPONDING DRIVE DEVICE

CROSS-REFERENCES TO RELATED APPLICATIONS

This application claims the priority of German Patent Application, Serial No. 10 2014 015 523.4, filed Oct. 20, 2014, pursuant to 35 U.S.C. 119(a)-(d), the content of which is incorporated herein by reference in its entirety as if fully set forth herein.

BACKGROUND OF THE INVENTION

The present invention relates to a method for operating a drive device with an internal combustion engine and an exhaust tract in which a storage catalytic converter for purification of exhaust gas of the internal combustion engine, a first lambda probe upstream of the storage catalytic converter and a second lambda probe downstream of the storage catalytic converter are arranged, wherein a lambda value for controlling a mixture composition is determined for the internal combustion engine from a measurement signal of the first lambda probe and an offset value. The invention further relates to a drive device.

The following discussion of related art is provided to assist the reader in understanding the advantages of the invention, and is not to be construed as an admission that this related art is prior art to this invention.

The drive device is used, for example, for driving a motor vehicle or is a component of the motor vehicle. It includes at least the internal combustion engine and the exhaust tract through which exhaust gas of the internal combustion engine is discharged, in particular toward the outside of the drive device. The storage catalytic converter is disposed in the exhaust tract of, which serves to clean the exhaust gas. The storage catalytic converter is implemented, for example, in the form of NO storage catalytic converter.

The drive device has at least two lambda probes. The first oxygen sensor is disposed upstream of the storage catalytic converter, so that it can be used to measure the oxygen content in the exhaust gas at this location. The first lambda probe is for this purpose arranged such that it at least partially protrudes into the exhaust gas or is in fluid communication with the exhaust gas, for example, is overflowed by the exhaust gas. Conversely, the second lambda probe is disposed downstream of the storage catalytic converter and is thus used to determine an oxygen content in the exhaust gas at this location. Like the first lambda probe, the second lambda probe protrudes at least partially into the exhaust gas or is in fluid communication with the exhaust gas, so it is particularly overflowed by the exhaust gas. For example, the first lambda probe is designed as a broadband lambda probe and the second lambda probe is designed as a jump lambda probe.

The measurement signal of the first lambda probe is used for controlling the mixture composition for the internal combustion engine. The composition of the fuel-air mixture supplied to the internal combustion engine is thereby obtained as a function of the measurement signal of the first lambda probe. To compensate for any error, especially an offset error, of the first lambda probe, the lambda value which ultimately forms the basis for controlling the mixture composition is determined from the measurement signal of the first lambda probe and the offset value. In particular, the lambda value results from the sum of the measurement signal and the offset value. In this way, the accuracy of the control of the mixture composition can be significantly improved.

For example, the offset value can be determined based on a measurement signal from the second lambda probe, in particular in the context of a trim control. In order to carry out a conventional trim control, which counterbalances a displacement (for example, due to age) of the mean value, corresponding to lambda=1, of the signal of the lambda probe, a trim controller receives an oxygen-dependent signal from a measuring sensor, e.g. a second lambda probe, disposed downstream of the catalytic converter. The measurement signal from the second lambda probe is then used to detect and to eventually correct an error of the first lambda probe. However, since the exhaust gas downstream of the lambda probe must first pass through the storage catalytic converter before it reaches the second lambda probe, the second lambda probe reacts only very slowly to a change in the exhaust gas composition, not least due to the storage capacity, in particular the oxygen storage capacity of the storage catalytic converter. The storage catalytic converter has an oxygen store for storing or temporarily storing the oxygen.

Due to the sluggish reaction, the trim control can be performed only very slowly, i.e. with a large time constant, in order to ensure a stable control loop. However, this means that the offset value can be adjusted only very slowly to compensate for the measurement error of the first lambda probe. This measurement error thus initially causes an undesirable deviation in the mixture composition, which leads to increased pollutant emissions of the drive device.

It would therefore be desirable and advantageous to obviate prior art shortcomings and to provide an improved method for operating a drive device, which in particular enables a more reliable control of the mixture composition.

SUMMARY OF THE INVENTION

According to one aspect of the present invention, an offset value is determined with a trim control, when a measurement signal from the second lambda probe is located in a normal operating range of values, and the offset value is adjusted in a regeneration time period, during which the storage catalytic converter is regenerated, by a particular correction value, if the measurement signal of second lambda probe outside the normal operating range of values. Accordingly, two different operating modes are provided. A first operating mode is performed when the measurement signal from the second lambda probe is located in the normal operating range of values. Conversely, the second operating mode is provided for a situation where the measurement signal from the second lambda probe is outside the normal operating range of values.

When a jump lambda sensor used as the second lambda probe, the normal operating range has as a lower limit, for example, at least 0.30 V, at least 0.35 V, at least 0.40 V, at least 0.45 V, or at least 0.50 V. For example, a maximum of 0.80 V, a maximum of 0.75 V or a maximum 0.70 V are envisioned as upper limits. The trim control is for example a PID trim control, i.e. a trim control using a PID controller.

If it is determined that the measurement signal of the second lambda probe is in the normal operating range of values, the usual procedure is applied, i.e. the offset value is determined with the trim control. For example, a PI controller is used for this purpose. By employing this procedure, a slow but very precise control is performed within the normal operating range of values, so that the offset value can be tuned very precisely to a possible error of the first lambda probe and the measurement signal of the first lambda probe can be precisely corrected.

However, if the measurement signal of the second lambda probe is outside the normal operating range of values, then only a coarse, but extremely rapid adaptation of the offset value shall be performed. For this purpose, the offset value is adjusted by using the predetermined correction value. For example, the correction value is added to the previous offset value to obtain a new offset value. Obviously, however, a subtraction is also a possible. The correction value can basically be selected as desired. For example, it may be constant. Alternatively, however, a variable correction value can also be realized.

Preferably, the offset value is adjusted with the correction value in the regeneration period, i.e. for example at the start, during or at the end of the regeneration period. The storage catalytic converter is regenerated during the regeneration period. The regeneration period or the regeneration of the storage catalytic converter, respectively, is initiated, for example, in response to the measurement signal of the second lambda probe. Preferably, the regeneration is performed when the measurement signal of the second lambda probe is outside the normal operating range of values.

The normal operating range of values is preferably selected for this purpose such that a deviation of the measurement signal of the second lambda probe from the normal operating range of values indicates that the storage catalytic converter or an oxygen store of the storage catalytic converter is either completely, or at least almost completely, filled or emptied. For example, regeneration of the storage catalytic converter or its oxygen store may be performed periodically, i.e. at certain time intervals, when the measurement signal of the second lambda probe is outside the normal operating range of values.

To regenerate the storage catalytic converter, the mixture composition is changed such that the storage catalytic converter is either filled or emptied—as a function of the measurement signal of the second lambda probe. For example, when the measurement signal of the second lambda probe Indicates an excess of oxygen in the exhaust gas downstream of the storage catalytic converter, the fuel proportion of the mixture supplied to the internal combustion engine is increased so that the mixture is richer and the exhaust gas contains less, more preferably no, unburned oxygen. Accordingly, the oxygen temporarily stored in the storage catalytic converter is discharged.

Conversely, of course, the fuel proportion of the mixture is reduced, so a richer mixture is present when the measurement signal of the second lambda probe indicates a lack of oxygen in the exhaust gas downstream of the storage catalytic converter. In this case, the amount of unburned oxygen present in the exhaust gas is increased, causing oxygen to be introduced into and temporarily stored in the storage catalytic converter. For example, enough oxygen is introduced into the storage catalytic converter or discharged from the storage catalytic converter, so that the storage catalytic converter or the oxygen store has at the end of the regeneration period a specific filling degree, for example 50%.

This change of the mixture supplied to the internal combustion engine occurs in the regeneration period. The mixture composition is changed at the beginning of the regeneration period and then again reset at the end of the regeneration period, in particular to the value that was determined by the control based on the measurement signal of the first lambda probe. Preferably, the trim control is suspended during the regeneration period, i.e. kept constant apart from the correction by the correction value.

According to another advantageous feature of the present invention, the offset value is adjusted at the start, during or at the end of the regeneration period. The offset value can in principle be adjusted by the specific correction value at any time. Preferably, the adjustment is made at the start of the regeneration period, during the regeneration period or at the end of the regeneration period, with the latter being preferred. The offset value, which directly influences the control of the mixture composition, is not adjusted when the mixture composition is actually determined based on the control. The operation of the internal combustion engine is therefore not affected by adjusting the offset value.

According to another advantageous feature of the present invention, regeneration of the storage catalytic converter involves filling or emptying an oxygen store, wherein for filling the oxygen store, the internal combustion engine is operated during a specified time period with a lean mixture composition, and for emptying with a richer mixture composition. This implies that the mixture composition is either leaner or richer in comparison to a mixture composition that results from the control based on the measurement signal of the first lambda probe. As already explained above, it is decided based on the measurement signal of the second lambda probe whether the oxygen store of the storage catalytic converter is to be filled or emptied.

According to a particularly preferred advantageous feature of the present invention, the regeneration period is initiated when the measurement signal from the second lambda probe is outside the normal operating range of values. This has already been mentioned above. Regeneration of the storage catalytic converter or of the oxygen store is only necessary when the measurement signal of the second lambda probe indicates either a completely filled or an at least almost completely filled or emptied oxygen store. However, a minimum time interval may be required between successive regeneration periods. This minimum time interval may, for example, be determined based on the measurement signal of the second lambda probe. The farther outside the normal operating range of values the measurement signal from the second lambda probe is located, the shorter is the minimum time interval that can be selected.

According to an advantageous feature of the present invention, the offset value is adjusted by the comedian value only when the measurement signal of the second lambda probe is outside the normal operating range of values by at least a predetermined difference value. I.e., the above-described regeneration may be performed when the measurement signal of the second lambda probe is outside the normal operating range of values. However, there is no need for always also adjusting the offset value. This is done only when the measurement signal is set apart from the respective closest limit of the normal operating range of values by an absolute amount that at least corresponds to or is greater than the specified difference value.

At smaller deviations of the measurement signal of the second lambda probe from the normal operating range of values, an attempt is made to already shift the measurement signal of the second oxygen sensor through regeneration into the normal operating range of values. The offset value can then be adjusted with the trim control. This approach prevents excessive jumps, when the measurement signal from the second lambda probe is already in the vicinity of the normal operating range of values.

According to another advantageous feature of the present invention, the offset value is also adjusted with the trim control, in particular outside the regeneration period, if the measurement signal from the second lambda probe is outside the normal operating range of values. Preferably, the offset value is determined by the trim control only outside the regeneration period. However, the trim control may be suspended during the regeneration period. Preferably, the offset value may also be determined with the trim control when the measurement signal from the second lambda probe is not within the normal operating range of values, so that the offset value is continuously corrected also in such an operating state. It is therefore not contemplated in this operating state, to make only a coarse correction by adjusting the offset value with the predetermined correction value.

According to another advantageous feature of the present invention, a first range of values is immediately adjacent to the normal operating range of values and has a width corresponding to the difference value. The first range of values is thus already outside the normal operating range of values. It is directly adjacent to this range and has a width corresponding to the difference value. Preferably, when a measurement value of the second oxygen sensor is located in the first range of values, it is contemplated to regenerate the storage catalytic converter, but not to adjust the offset value with the correction value, but more particularly with the trim control. Preferably, several first ranges of values exist, which are in each case located on opposite sides of the normal operating range of values.

According to another advantageous feature of the present invention, a second range of values directly adjoins the normal operating range of values on the side facing away from the first range of values. If the measurement signal of the second lambda probe is located in the second range of values, then the offset value is adjusted by the determined correction value, particularly in the context of the regeneration period in accordance with the foregoing description. In analogy to the first range of values, several second ranges of values preferably exist, namely on respective opposite sides of the normal operating range of values.

Lastly, according to another advantageous feature of the present invention, the correction value may be determined as a function of the measurement signal of the first lambda probe and/or the second lambda probe. For example, the correction value is chosen to be the greater the farther the measurement signal of the second lambda probe is located outside the normal operating range of values. Larger deviations indicate a stronger correction or adjustment of the offset value. Thus, the offset value can be very quickly adjusted to the actual conditions or to the error of the first lambda probe.

According to another advantageous feature of the present invention, the correction value may be determined from the filling state of the storage catalytic converter, an exhaust gas mass flow and a time variable. The correction value preferably indicates at least approximately the difference between the combination of the measurement signal of the first lambda probe and the offset value and the actual conditions in the exhaust gas. The filling state is the filling level of the storage catalytic converter or of the oxygen store with oxygen. The exhaust gas mass flow describes the amount, in particular the mass of the exhaust gas per unit of time, which passes through the storage catalytic converter. The mass of the exhaust gas flowing through the catalytic converter within a specified period can then be determined from the exhaust gas mass flow and the time variable. The time variable corresponds, for example, to the time interval between the start times of immediately successive regeneration periods.

The mass of the oxygen that is at least theoretically stored in the oxygen store is obtained from the relationship $$m_{O2}=(\lambda-1)*\dot{m}*\Delta t,$$

wherein $\lambda$ corresponds to a lambda value, $\dot{m}$ corresponds to the exhaust gas mass flow, and $\Delta t$ corresponds to the time variable. The mass of oxygen $m_{O2}$ is preferably determined at the end of the specified time period with the above relationship or is alternatively determined during the regeneration period by integration. The lambda value $\lambda$ corresponds to the measurement signal of the first lambda probe corrected by the offset value or is at least determined therefrom.

The correction value $\Delta\lambda$ can now be determined, for example, from the relationship $$\Delta\lambda = 1 + \frac{\Delta m_{O2}}{\dot{m} * \Delta t},$$

wherein the above variables correspond to the ones defined previously. Preferably, the oxygen mass difference $\Delta m_{O2}$ is used as a basis for the determination, which is determined by the filling state of the storage catalytic converter and calculated in accordance with the mass of oxygen $m_{O2}$ from the above relationship. In particular, the oxygen mass difference is the difference between these two quantities. The offset value may also be determined directly with the aforementioned relationship or be set equal to the correction value.

According to another advantageous feature of the present invention, a method is realized wherein in a first step, the degree of the filling level of the oxygen store is determined with the lambda probe upstream of the storage catalytic converter that may potentially include a tolerance, and wherein in a second step the same degree of the filling level of the oxygen store is determined more accurately when the more accurate lambda probe downstream of the catalytic converter exceeds a first threshold voltage or is below a second threshold voltage, based on the voltage level of the lambda probe downstream of the storage catalytic converter, and subsequently the measurement signal of the lambda probe upstream of the catalytic converter that is subject to tolerances is adjusted based on the difference between the two methods for determining the degree of filling of the oxygen store.

For example, in a first step, a first filling level of the storage catalytic converter or of the oxygen store is determined based on the measurement signal of the first lambda probe, in particular corrected by the offset value. In a second step, a second degree of filling of the storage catalytic converter or of the oxygen store is preferably determined, namely based on the measurement signal of the second lambda probe. In particular, it is decided based on the measurement signal of the second lambda probe whether the second filling level is set to a first value or a second value. The first value corresponds, for example, to a maximum mass of oxygen, the second value to a minimum mass of oxygen.

Specifically, the second filling level is set to the first value when the measurement signal of the second lambda probe is smaller than a predetermined first limit value, in particular is below the normal operating range of values, and/or is set to the second value when the measurement signal of the second oxygen sensor is greater than a predetermined second threshold value, in particular is above the normal operating range of values. The first threshold thus preferably corresponds to a lower limit of the normal operating range of values, whereas the second limit value corresponds to an upper limit of the normal operating range of values. The correction value and/or the offset value is then determined from the difference between the first filling level and the second filling level.

Because the second lambda probe has in particular after the lapse of the specified period of time a duration that corresponds to the time variable, it is assumed that the oxygen store is at the end of the period of time either completely empty or completely filled, i.e. that a certain mass of oxygen is present in the storage catalytic converter that is equivalent either to the minimum or to the maximum mass of oxygen. A deviation in the existing mass of oxygen, namely the oxygen mass difference, can then be calculated from the difference between this mass of oxygen and the mass of oxygen computationally introduced in the storage catalytic converter. The correction value and/or the offset value are subsequently determined from this deviation, wherein the correction value is preferably proportional to the difference.

The correction value can be determined, for example, at the end of the regeneration period from a time average of the exhaust gas mass flow during the regeneration period. Alternatively, the correction value or the oxygen mass difference may be determined from a time-resolved exhaust gas mass flow determination by integration or addition at certain times during the regeneration period. In this way, the accuracy of the determination of the correction value can be further improved.

According to another aspect of the invention, a drive device, in particular for carrying out the aforedescribed method, includes an internal combustion engine and an exhaust tract, in which a storage catalytic converter for purification of exhaust gas of the internal combustion engine, a first lambda probe upstream of the storage catalytic converter and a second lambda probe downstream of the storage catalytic converter are arranged, wherein the drive device is configured to determine a lambda value for controlling a mixture composition for the internal combustion engine from a measurement signal of the first lambda probe and an offset value.

The drive device is hereby configured to determine the offset value by way of a trim control, when a measurement signal from the second lambda probe is located in a normal operating range of values, and to adjust the offset value during a regeneration period, during which the storage catalytic converter is regenerated, by a specific correction value, when the measurement signal of the second lambda probe is outside the normal operating range of values. The advantages of such an approach or of such a configuration of the drive device have already been discussed. Both the drive device and the method can be further developed in accordance with the foregoing discussion, to which reference is being made.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
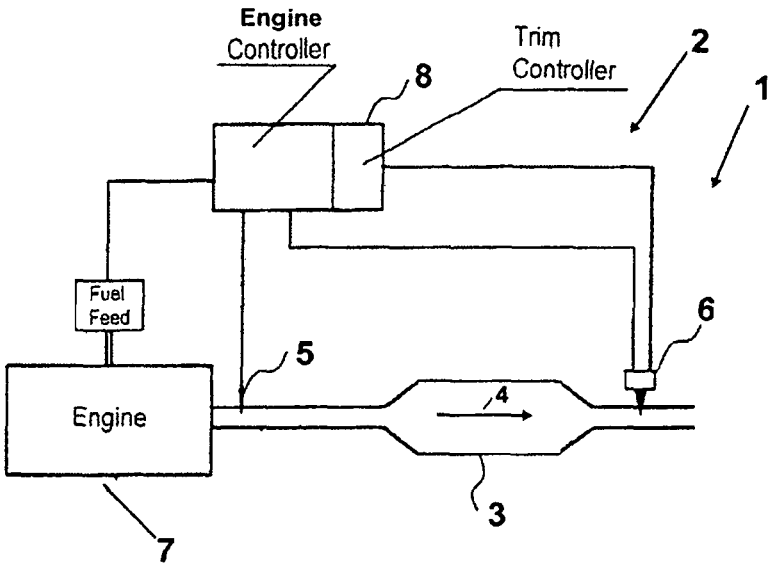
FIG 1 (Prior Art)
FIG. 1 shows a schematic diagram of a portion of a drive device, in particular an exhaust tract.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a portion of a drive device 1, in particular an exhaust tract 2. The drive device 1 furthermore has an internal combustion engine 7, whose exhaust gas is discharged through the exhaust tract 2, in particular toward an external environment of the drive device 1. A storage catalytic converter 3 is arranged in the exhaust tract 2, through which exhaust gas from the internal combustion engine flows in the direction of arrow 4. A first lambda probe 5 which provides a first measurement signal is arranged upstream of the storage catalytic converter 3. The first measurement signal from the first lambda probe 5 is fed to an engine controller of the internal combustion engine 7. A lambda value which is subsequently used to control a mixture composition via a fuel feed for the internal combustion engine is determined from the first measurement signal by using an offset value.

A second lambda probe 6 is arranged downstream of the storage catalytic converter 3. Preferably, the first lambda probe 5 is located directly upstream of the storage catalytic converter 3 and/or the second lambda probe 6 is located directly downstream of the storage catalytic converter 3. The second lambda sensor 6 provides a second measurement signal which is supplied to the engine controller and a trim controller 8. The so-called "trim control" of the fuel mixture enables correction of the signal associated with Lambda=1, so that the Lambda value most advantageous for catalytic conversion is always maintained. For example, the first lambda probe 5 is a broadband lambda probe whereas the second lambda probe 6 is a jump lambda probe.

Figure 2:
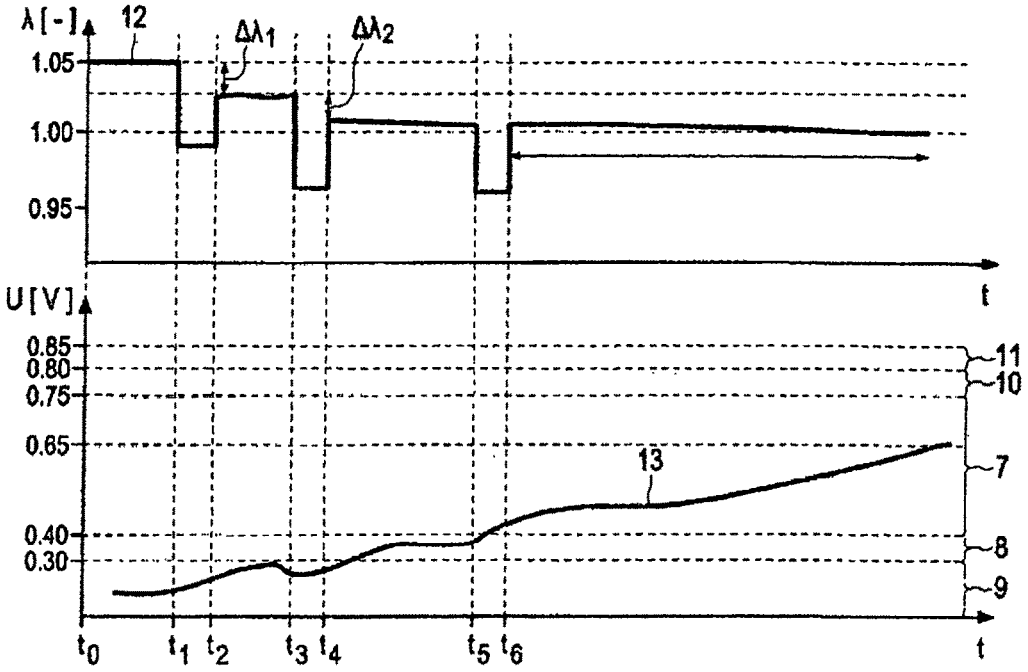
FIG. 2 shows two diagrams, based on which a method according to the present invention for operating the drive device will be described.

FIG. 2 shows two diagrams, wherein the lambda value $\lambda$ determined from the measurement signal of the first lambda probe 5 and the offset value are plotted as a function of the time t in an upper diagram. Conversely, the measurement signal U of the second lambda probe 6 is plotted as a function of the time t in a lower diagram. A normal operating range 7 is indicated in the lower diagram, which purely as an example extends from 0.40 V to 0.75 V. It will be understood that a different value can be selected for the lower limit and/or the upper limit. In the normal operating range of values 7, no concrete statement concerning the filling state of the storage catalytic converter 3 or of an oxygen store of the storage catalytic converter 3 is possible. For this reason, a control, in particular a PID control, is performed as a trim control to determine the offset value when the measurement signal U of the second lambda probe 6 is in the normal operating range of values 7.

Adjoining the normal operating range of values 7 are a first value range 8 towards smaller values and a second value range 9. The first value range 8 is directly adjacent to the normal operating range of values 7, whereas the second value range 9 adjoins the first range of values 8 on the side facing away from the normal operating range of values 7. The same applies towards higher voltages for a first range of values 10 and a second range of values 11.

A curve 12 in the upper diagram shows the course of the lambda value λ as a function of time t, whereas a curve 13 in the lower diagram shows the course of the measurement signal of the second lambda probe 6 as a function of time t. During operation of the drive device 1, the offset value, from which the lambda value for controlling the mixture composition for the internal combustion engine is determined, is determined by way of the trim control, in particular the PID trim control, if the measurement signal of the second lambda probe 6 in the normal operating range of values 7.

Conversely, when the measurement signal of the second lambda probe is outside this normal operating range of values 7, the offset value is adjusted by a predetermined correction value. The correction value may, for example, be constant or may be determined as a function of the measurement signal of the first lambda probe 5 and/or the measurement signal of the second lambda probe 6. In a particularly preferred embodiment, the correction value is determined from the filling state of the storage catalytic converter, an exhaust gas mass flow rate and the duration of the regeneration period.

It is clear that the curve 13 is the second range of values 9 during the period $t_0 \leq t \leq t_1$, i.e. outside the normal operating range of values 7. Accordingly, a regeneration period is initiated at the time $t=t_1$ during which the storage catalytic converter 3 and/or an oxygen store of the storage catalytic converter 3 are regenerated. This includes filling or emptying the oxygen store, depending on the measurement signal of the second lambda probe 6.

In the illustrated exemplary embodiment, an excess of oxygen is present, so that the oxygen store is filled, in particular completely filled. Accordingly, the oxygen store is emptied during the regeneration period. To this end, the internal combustion engine is operated with a richer mixture composition than before, i.e. for $t<t_1$. This is immediately evident from the lambda value according to the curve 12. The regeneration period extends from $t_1$ to $t_2$. At the end of the regeneration period, i.e. at $t=t_2$, the offset value is adjusted with the determined correction value. This is also clearly evident in curve 12, where the offset value is denoted with $\Delta\lambda_1$. The correction value is hereby determined in particular from the filling state of the storage catalytic converter, the exhaust gas mass flow and the duration of the regeneration period.

Subsequently, the mixture composition is again controlled during the period $t_2<t<t_3$ by using the lambda value. However, because the measurement signal of the second lambda probe 6 according to the curve 13 is still outside the normal operating range of values, a regeneration period is again initiated, extending from $t_3$ to $t_4$. The offset value is again adjusted at the end of the regeneration period, wherein the correction value in the curve 12 is now referred to as $\Delta\lambda_2$. The offset value for $t>t_4$ is once more determined by way of the trim control. As can be seen, the measurement signal of the second lambda probe 6 increases and moves out of the second range of values 9 into the first range of values 8.

It is contemplated that the offset value is only adjusted with the correction value when the measurement signal of the second lambda probe is outside the normal operating range of values 7 at least by a predetermined difference value. This difference value corresponds to the width of the first range of values 8, so that although a regeneration period is initiated again at the time $t_5$, which extends up to the time $t_6$, the offset value is not adjusted with the determined correction value at the end of this regeneration period. As a result of the regeneration of the storage catalytic converter in the last-described regeneration period, the measurement signal of the second lambda probe 6 increases further and reaches the normal operating range of values 7. Consequently, the offset value is then determined only by way of the trim control following the regeneration period.

It is therefore not necessary to again initiate a regeneration of the storage catalytic converter 3 and/or to adjust the offset value. Instead, the offset value could in this manner be adjusted to an error of the first lambda probe 5 much faster than would have been possible by using only the trim control. Accordingly, the mixture composition for the internal combustion engine can be controlled more accurately and faster, resulting in a lower pollutant emission of the internal combustion engine.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A method for operating a drive device, the drive device comprising an internal combustion engine and an exhaust gas tract having a storage catalytic converter for purifying exhaust gas from the internal combustion engine, a first lambda probe disposed upstream of the storage catalytic converter and a second lambda probe disposed downstream of the storage catalytic converter, the method comprising:

determining a lambda value for controlling a mixture composition for the internal combustion engine based on a measurement signal from the first lambda probe and a lambda offset value, wherein the lambda offset value is determined by way of a trim control designed to adjust the mixture composition when a measurement signal of the second lambda probe is in a normal operating range of values, and adjusting the lambda offset value in a regeneration period, during which the storage catalytic converter is regenerated, with a predetermined correction value when the measurement signal of the second lambda probe is outside the normal operating range of values.

2. The method of claim 1, wherein the lambda offset value is adjusted at a start, during or at an end of the regeneration period.

3. The method of claim 1, wherein regeneration of the storage catalytic converter comprises filling or emptying an oxygen store of the storage catalytic converter, wherein for filling the oxygen store, the internal combustion engine is operated over a specified time period with a lean mixture composition and for emptying the oxygen store, the internal combustion engine is operated with a richer mixture composition.

4. The method of claim 1, wherein the regeneration period is initiated when the measurement signal of the second lambda probe is outside the normal operating range of values.

5. The method of claim 1, wherein the lambda offset value is adjusted with the predetermined correction value only when the measurement signal of the second lambda probe is outside the normal operating range of values by at least a predetermined difference value.

6. The method of claim 5, wherein a first value range directly adjoins the normal operating range of values and has a width corresponding to the predetermined difference value.

7. The method of claim 6, wherein a second value range directly adjoins the first value range on a side facing away from the normal operating range of values.

8. The method of claim 1, wherein the lambda offset value is adjusted by way of the trim control even when the measurement signal of the second lambda probe is outside the normal operating range of values.

9. The method of claim 8, wherein the lambda offset value is adjusted by way of the trim control outside the regeneration period even when the measurement signal of the second lambda probe is outside the normal operating range of values.

10. The method of claim 1, wherein the predetermined correction value is determined as a function of the measurement signal of at least one of the first lambda probe and the second lambda probe.

11. The method of claim 1, wherein the predetermined correction value is determined from a filling state of the storage catalytic converter, an exhaust gas mass flow and a time variable.

12. A drive device, comprising an internal combustion engine, and an exhaust gas tract having a storage catalytic converter for purifying exhaust gas from the internal combustion engine, a first lambda probe disposed upstream of the storage catalytic converter and a second oxygen sensor disposed downstream of the storage catalytic converter, wherein the drive device is configured to determine a lambda value for controlling a mixture composition for the internal combustion engine from a measurement signal of the first lambda probe and a lambda offset value, wherein the lambda offset value is determined by way of a trim control designed to adjust the mixture composition, when a measurement signal of the second lambda probe is in a normal operating range of values, and adjust the lambda offset value by a predetermined correction value in a regeneration period, during which the storage catalytic converter is regenerated, when the measurement signal of the second lambda probe is outside the normal operating range of values.

* * * * *